US005884495A

United States Patent [19]

Powell et al.

[11] Patent Number: 5,884,495

[45] Date of Patent: Mar. 23, 1999

[54] DEHUMIDIFIER WITH AN ADJUSTABLE FLOAT FOR SETTING THE MOISTURE LEVEL SHUT OFF

[75] Inventors: David E. Powell; Christopher M. Thompson, both of Nashville, Tenn.

[73] Assignee: Whirlpool Corporation, Benton Harbor, Mich.

[21] Appl. No.: 948,156

[22] Filed: Oct. 9, 1997

[51] Int. Cl.[6] ..... F25D 21/00; H01H 35/42

[52] U.S. Cl. ..... 62/150; 62/188; 20/61.07

[58] Field of Search ..... 62/188, 150, 161, 62/93, 285, 291; 236/44 R; 200/61.04, 61.07

[56] References Cited

U.S. PATENT DOCUMENTS

| | | | |
|---|---|---|---|
| 2,663,312 | 12/1953 | Continenza | 62/188 |
| 3,044,272 | 7/1962 | Eisendrath | 62/188 |
| 3,110,161 | 11/1963 | Maleck | 62/150 |
| 3,297,844 | 1/1967 | Eisendrath | 200/84 R |
| 3,500,654 | 3/1970 | Sholtes | 62/150 |
| 3,501,609 | 3/1970 | Willcox et al. | 200/172 |
| 3,630,000 | 12/1971 | Mullings | 55/139 |
| 4,254,311 | 3/1981 | Sisk, Jr. | 200/61.07 |
| 4,475,359 | 10/1984 | Sano | 62/272 |
| 4,497,182 | 2/1985 | Youngworth | 62/151 |
| 4,554,794 | 11/1985 | Khan | 62/150 |
| 4,742,691 | 5/1988 | Kennedy | 62/272 |
| 5,074,119 | 12/1991 | Anderson | 62/150 |
| 5,117,651 | 6/1992 | Suh | 62/288 |
| 5,188,169 | 2/1993 | Lim | 165/20 |
| 5,245,834 | 9/1993 | Choi | 62/150 |

*Primary Examiner*—William Doerrler
*Attorney, Agent, or Firm*—Robert O. Rice; Joel M. Van Winkle; Stephen D. Krefman

[57] ABSTRACT

The invention is a dehumidifier comprising an adjustable float with a variable height cam surface that is in contact with the actuator of an interlock switch, which controls the supply of power to the refrigeration system of the dehumidifier. The float is rotatably mounted to the collection bucket of the dehumidifier and rotates as the bucket fills with liquid. At a sufficient amount of rotation, the cam surface will no longer be in contact with the actuator of the interlock switch, resulting in the removal of power from the refrigeration system. The float can be laterally adjusted so that a variable height cam surface is aligned with the actuator of the interlock switch to permit the user to vary the liquid level at which the interlock switch is activated to cut off power to the refrigeration system.

16 Claims, 3 Drawing Sheets

DEHUMIDIFIER WITH AN ADJUSTABLE FLOAT FOR SETTING THE MOISTURE LEVEL SHUT OFF

BACKGROUND OF THE INVENTION

1. Field of the Invention

The invention relates to dehumidifiers for removing moisture from the surrounding atmosphere; and, more particularly, to an adjustable float for a dehumidifier that provides for setting the liquid level at which the dehumidifier turns off to control the volume of liquid retained by the dehumidifier.

2. Description of the Related Art

Dehumidifiers are a well known household appliance used to remove moisture from the atmosphere. A typical household dehumidifier will comprise a cabinet in which a refrigeration system is disposed. The refrigeration system removes moisture from the air by condensing the moisture on the cooled evaporator coils of the refrigeration system. The moisture is typically collected in a retainer or bucket that is disposed beneath the cooled evaporator coils to catch the moisture as it drips from the evaporator coils.

Typically, some type of sensor is used to measure the level of liquid collected in the bucket to turn off the refrigeration system of the dehumidifier when the liquid reaches an appropriate level to prevent the overflow of the liquid within the bucket. In previous dehumnidifiers, a common practice is to provide a float within the bucket that rises with the level of the liquid and actuates a switch controlling power to the refrigeration system to turn off the refrigeration system once the liquid level reaches a predetermined height. One disadvantage of this class of dehumidifiers is that the sensor typically does not shut off the refrigeration system until the bucket is substantially full and does not provide any means for adjusting the liquid level at which the power to the refrigeration system has turned off, resulting in many users spilling the liquid from the bucket as they remove the bucket from the dehumidifier for draining and, some users, particularly the elderly, find the full bucket too heavy to easily and safely to remove and carry to drain the bucket.

Some previous dehumidifiers have attempted to provide for adjusting the liquid level at which the refrigeration system is turned off. Typically, these dehumidifiers incorporated a bucket whose upper rim was pivotally mounted to an exterior surface of the cabinet and whose lower portion rested against a spring mounted to the exterior of the cabinet. The spring provided an opposing force to the pivoting weight of the bucket to initially keep the bucket a predetermined distance from a switch controlling the refrigeration system. As the bucket filled with water, the bucket applied a force to the spring greater than the spring, permitting the bucket to contact the switch and turn off the power to the refrigeration system. To adjust the liquid level with these types of systems, the distance the spring extended from the cabinet was adjusted or the amount of spring force was adjusted.

Although these types of liquid level systems generally performed satisfactorily, they needlessly add another component, the spring, to the dehumidifier. The addition of the extra component results in extra costs during manufacturing and in the storing of additional parts. Also, some of the previous liquid level adjustment systems required a tool to adjust the spring tension. It is desirable to provide a dehumidifier that has an adjustable liquid level without the need for the addition of extra parts and to provide greater ease for the user in adjusting the liquid level shut off.

SUMMARY OF THE INVENTION

Applicant's invention addresses the disadvantages of previous dehumidifiers by providing a dehumidifier that has an adjustable float used to vary the liquid level at which the refrigeration system of the dehumidifier is turned off.

In the preferred embodiment, the invention is a dehumidifier having a cabinet in which is disposed a refrigeration system for extracting moisture from the atmosphere. The refrigeration system includes an interlock switch for controlling the power to the refrigeration system and, thus, the extraction of moisture. A bucket is removably mounted to the cabinet to collect the extracted moisture. An adjustable float is provided within the bucket and responds to the bucket moisture level. The float has an actuator that actuates the interlock to control the power supplied to the refrigeration system. By adjusting the float, the moisture level, at which the power is turned off, can be controlled by the user.

DESCRIPTION OF THE PREFERRED EMBODIMENT

Figure 1:
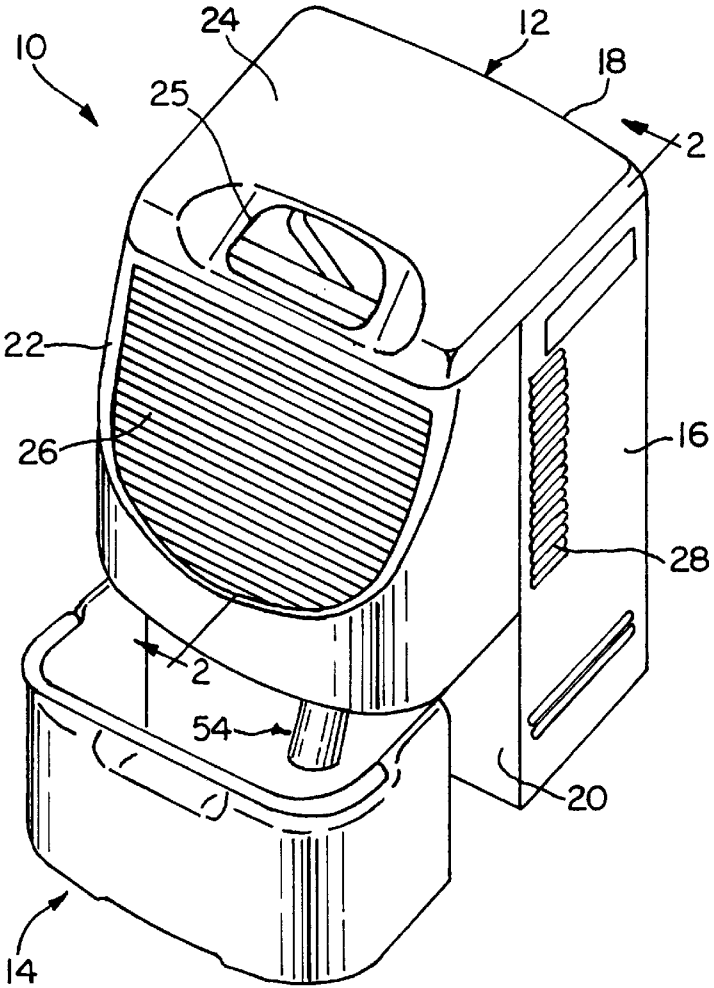
FIG. 1 illustrates a dehumidifier in accordance with the invention with the moisture collection bucket shown in a partially removed position to better illustrate a float within the bucket.

FIG. 1 illustrates a dehumidifier 10 according to the invention. The dehumidifier 10 comprises a cabinet 12 to which is removably mounted a bucket 14. The cabinet 12 can be conceptually divided into a front and a rear portion. The rear portion comprises opposing side walls 16, rear wall 18, and a partial front wall 20. The front portion comprises an overhang 22, which is disposed above the bucket 14 when the bucket 14 is mounted to the cabinet 12. A top wall 24 extends across the rear portion and the front portion.

The junction of the lower portion of the overhang 22 and the partial front wall 20 define a recess in which the bucket 14 is received. A control panel 25 is provided on the top wall and provides for the user to control the operations of the dehumidifier 10.

Figure 2:
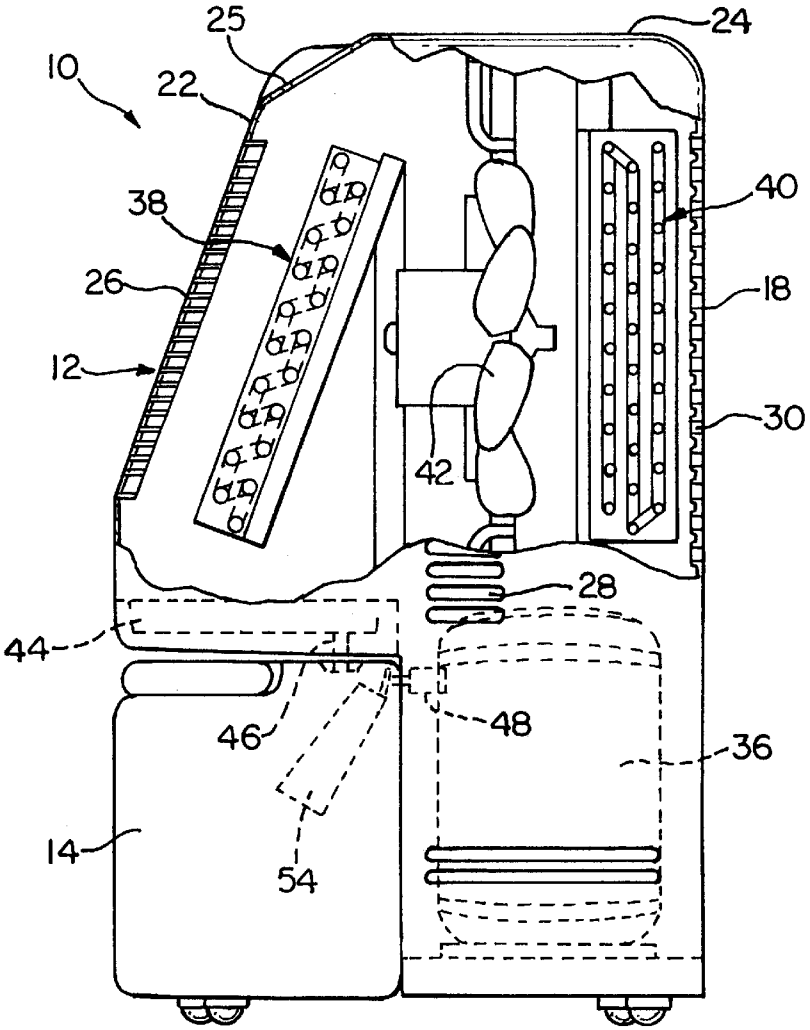
FIG. 2 is a side sectional view taken along line 2 of FIG. 1 with the bucket in the seated position.

To provide for air flow through the cabinet, the overhang 22 has a front vent 26, the side walls 16 have bypass vents 28 and the rear wall 18 has a rear vent 30 (as shown in FIG. 2).

Referring to FIG. 2, the internal structure of the dehumidifier 10 will be described in greater detail. A refrigeration system is disposed within the cabinet 12 of the dehumidifier 10. The refrigeration system comprises a compressor 36, evaporator 38, condenser 40, and a fan 42. This type of refrigeration system is well known in the art and will not be described further. A drip pan 44 is disposed beneath the evaporator 38 to catch the moisture condensed on the evaporator as it drips. The drip pan 44 has a collection tube 46, which directs the dripping liquid into the bucket 14.

An interlock switch 48 is mounted to the front wall 20 and has an actuator that extends into the bucket recess. The interlock switch 48 controls the supply of power to the compressor 36. When the interlock switch 48 is depressed, the power is engaged to the compressor 36 to run the refrigeration system.

Figure 3:
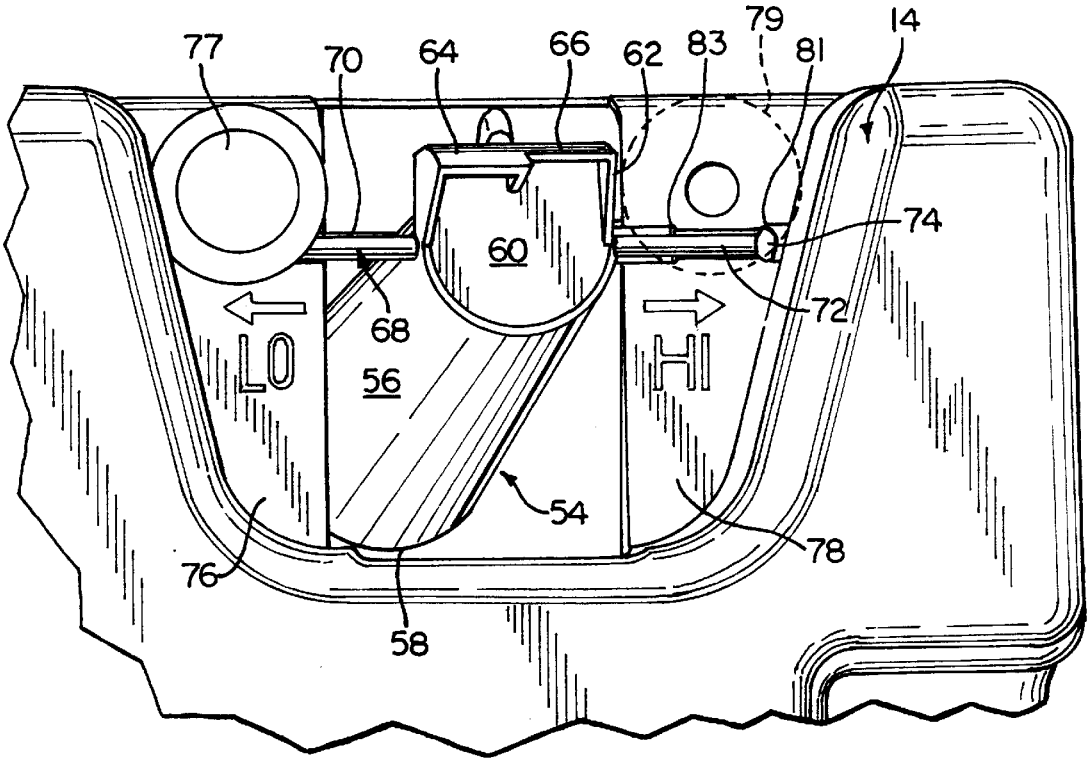
FIG. 3 is an enlarged perspective view of the float of FIG. 1.
Figure 4:
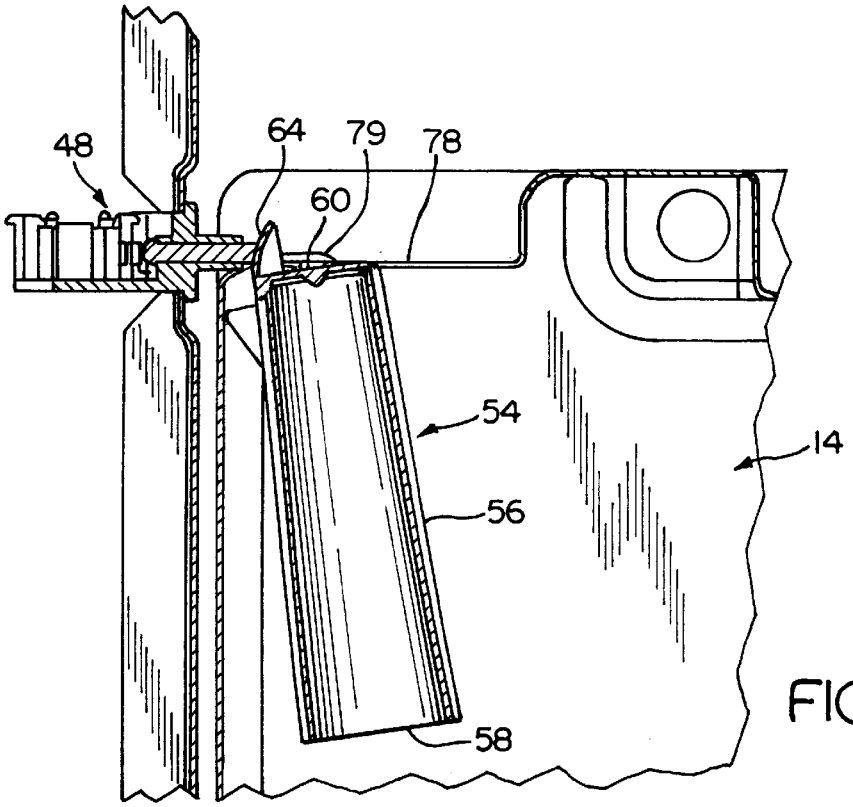
FIG. 4 is an enlarged sectional view illustrating an unactuated position of the float and no moisture within the bucket.

An adjustable float 54 according to the invention is provided within the bucket 14. As best seen in FIGS. 2–4, the adjustable float 54 comprises a hollow tubular body 56 having an open bottom end 58 and a closed top 60. A variable height cam 62 is provided on the closed top 60 and preferably comprises multiple cam surfaces 64 and 66 having generally similar arcuate cross sections but having different heights. Although the variable height cam 62 is illustrated in the preferred embodiment as comprising multiple cam surfaces of different heights, it is within the scope of the invention for the variable height cam 62 to comprise a continuously variable cam surface or more than two discrete cam surfaces as shown in the preferred embodiment. Preferably, only one of the cam surfaces 64, 66 is aligned and in contact with the interlock switch 48 at a given time.

The float 54 is pivotally mounted to the bucket 14 by a positioning shaft 68 extending from the closed top 60 in a direction that is generally transverse of the longitudinal axis of the tubular body 56. The positioning shaft 68 has a first end 70 and a second end 72 on which is formed a stop 74.

To pivotally mount the float 54 to the bucket 14, the first and second ends 70, 72 of the float 54 are received within channels of corresponding flanges 76 and 78 extending from the wall of the bucket 14. The positioning shaft 68 is retained within the channels by clips 77 and 79, respectively. The clips 77, 79 each have a stem received within an opening in the flanges 76, 78 and a head partially overlying their respective channel The positioning shaft 68 is also free to slide within the channels of the flanges 76, 78 which is in a direction that is transverse relative to the interlock switch 48. Thus, by sliding the float transversely to the interlock switch 48, it is possible to position either of the cam surfaces 64, 66 in front of the actuator of the interlock switch 48. In doing so, the user is able to simply slide the float 54 to adjust the liquid level at which the actuator of the interlock switch is actuated to turn off power to the refrigeration system. One of the channels has detents 81 and 83 in which is received the stop 74 of the stem 68 to lock the float 54 in a position corresponding to the selected cam surface 64, 66 and its associated water level.

Figure 5:
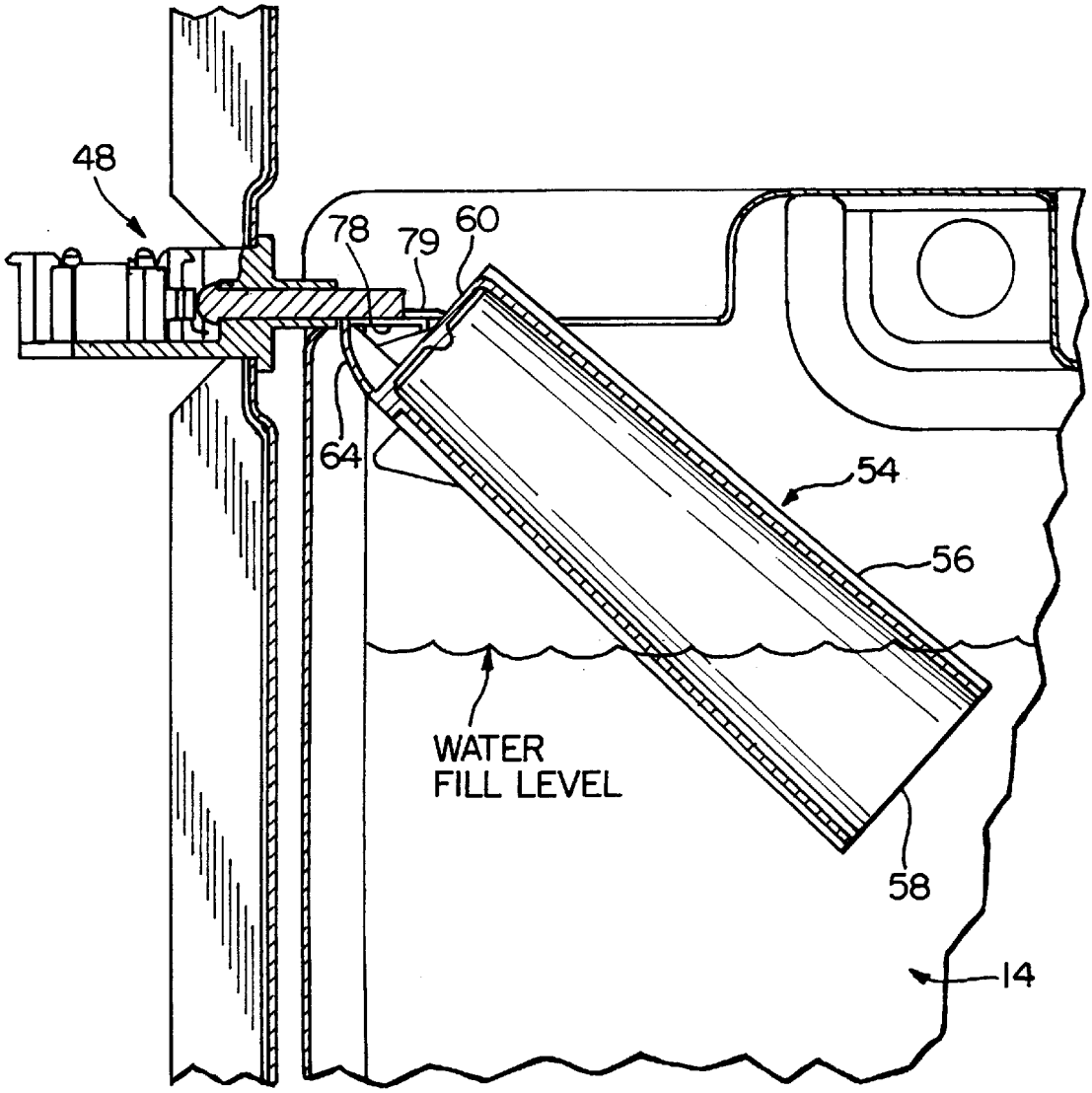
FIG. 5 is similar to FIG. 4 except that the float is shown in the actuated position and the associated moisture level.

The operation of the dehumidifier 10 will be described with respect to FIGS. 4 and 5. In operation, the dehumidifier is started with the bucket being empty of water and the float 54 is in the start position as illustrated by FIG. 4. As the refrigeration system is operated and liquid begins dripping from the evaporator into the drip pan where it is directed into the bucket by the collection tube 46, the bucket begins to fill with liquid removed from the atmosphere. As the bucket begins to fill with liquid, the liquid rises above the open bottom 58 of the float 54, trapping air within the tubular body 56 of the float to provide buoyancy to the float 54. Advantageously, because the float opens downwardly, dirt, dust, and other residue will not collect within the float as is common in floats that open upwardly.

As the liquid level in the bucket 14 continues to rise, the float 54 rotates and the cam surface 64 or 66 that is aligned with the interlock switch 48 rotates while maintaining contact with the interlock switch 48. Ultimately, the liquid level will rise to a height where the float will rotate an amount great enough so that the end of the cam surface 64 or 66 is disposed below the actuator in the stop position as illustrated in FIG. 5, resulting in the interlock switch moving outwardly and switching off the power to the refrigeration system to stop the removal of liquid from the atmosphere. At this time, a light or other indicator will be shown on the control panel, indicating to the user that the bucket is full of liquid and needs to be removed.

After the user removes the bucket and disposes of the liquid contained therein, the user replaces the bucket. If the bucket is not remounted correctly, the float 54 will not depress the actuator and power will not be supplied to the refrigeration system. In this manner, the float 54 functions as a safety device to make sure that the bucket 14 is properly positioned before power is supplied to the refrigeration system, preventing the potential accident of the removed moisture spilling onto the floor.

If the user determines that the shut off liquid level is at an undesirable height, then the user merely needs to transversely slide the float 54 relative to the actuator of the interlock switch 48 to select a different cam surface. As the user slides the float, the stop 74 will come to rest in one of the detents 81, 83, providing the user with an indicator that the float is properly positioned. The flanges 76, 78 can be provided with indicia, such as HI and LO, to indicate the selected water level. It should be obvious that a cam surface of a shorter height will provide for less rotation of the float before releasing the interlock switch 48. Thus, a shorter height cam surface will result in less liquid in the bucket 14 and a lower full height.

If more than two fill levels are desired, the variable height cam can be made with more than two discrete cam surfaces. Alternatively, as stated earlier, it is within the scope of the invention for the cam surface to have a continuously variable height so that the user can fine tune the shut off level of the liquid in the bucket 14.

Unlike prior dehumidifiers which required extra components to achieve liquid level adjustment, the invention incorporates the liquid level adjustment into the float that is already present in the dehumidifier, resulting in a reduced part count and simpler assembly than previous dehumidifiers. These benefits are extremely important in mass produced commodities such as a dehumidifier.

We claim:

1. A dehumidifier for extracting moisture from the atmosphere, the dehumidifier comprising:

a cabinet;

a refrigeration system generally disposed within the cabinet for extracting moisture from the atmosphere and including an interlock switch for turning on and off the power to the refrigeration system;

a bucket removably mounted to the cabinet to collect the moisture extracted by the refrigeration system; and an adjustable float provided within the bucket and responding to the moisture level in the bucket, the adjustable float having an actuator for actuating the interlock switch in response to the moisture level in the bucket to turn the power off and on, and wherein the float is slidably mounted to one of the bucket and the cabinet for sliding movement between at least two positions to adjust the float and wherein when the float is in a first of the at least two positions, the actuator actuates the interlock switch to turn off the power at a first moisture level, and when the float is in a second of the at least two positions, the actuator actuates the interlock switch at a second moisture level to turn off the power at a second moisture level.

2. A dehumidifier as claimed in claim 1, wherein the actuator is a variable height cam having a portion in contact with the interlock switch and the float is rotatably mounted to one of the bucket and the cabinet to thereby rotate in response to the moisture level from a run position, where the portion of the cam is in contact with the interlock switch and power is supplied to the refrigeration system, to an off position, where the portion of the cam is not in contact with the interlock switch and power is not supplied to the refrigeration system.

3. A dehumidifier as claimed in claim 2, wherein the variable height cam comprises at least two discrete sections of different heights and only one of the at least two discrete cam sections aligns with the interlock switch for each of the at least two positions of the float to provide for the adjustment of the float to turn off the refrigeration system at different moisture levels by sliding the float between the at least two positions.

4. A dehumidifier as claimed in claim 2, wherein the float further comprises an adjustment rod and the bucket has a pair of collars that receive the adjustment rod wherein the adjustment rod can be slid and rotated relative to the collars to slidably and pivotally mount the float to the bucket.

5. A dehumidifier as claimed in claim 4, wherein the float comprises a tubular body having a closed top and an open bottom and the adjustment rod is mounted near the closed top so that the open bottom is disposed in the collected moisture.

6. A dehumidifier as claimed in claim 1, wherein the float is mounted to the bucket.

7. A dehumidifier for extracting moisture from the atmosphere, the dehumidifier comprising:

a cabinet;

a refrigeration system generally disposed within the cabinet for extracting moisture from the atmosphere and including an interlock switch for turning on and off the power to the refrigeration system;

a bucket removably mounted to the cabinet to collect the moisture extracted by the refrigeration system; and an adjustable float rotatably mounted to the bucket for rotation in response to the moisture level in the bucket, the adjustable float having a variable height cam surface for actuating the interlock switch at a predetermined rotational position of the float to turn the power off, and wherein the position of the cam surface can be adjusted relative to the interlock switch to provide for the actuation of the interlock switch at more than one rotational position of the float to thereby permit the user to select the moisture level at which the power is turned off.

8. A dehumidifier as claimed in claim 7, wherein the float is slidably mounted to the bucket for sliding movement between at least two positions to alter the position of the cam surface relative to the interlock switch between at least two positions and wherein when the float is in a first of the at least two positions, the actuator actuates the interlock switch at a first rotational position to turn off the power at a first moisture level, and when the float is in a second of the at least two positions, the actuator actuates the interlock switch at a second rotational position to turn off the power at a second moisture level.

9. A dehumidifier as claimed in claim 8, wherein the variable height cam comprises at least two discrete sections of different heights and only one of the at least two discrete cam sections aligns with the interlock switch for each of the at least two positions of the float to provide for the adjustment of the float to turn off the refrigeration system at different moisture levels by sliding the float between the at least two positions.

10. A dehumidifier as claimed in claim 9, wherein the float further comprises an adjustment rod and the bucket has a pair of collars that receive the adjustment rod wherein the adjustment rod can be slid and rotated relative to the collars to slidably and rotatably mount the float to the bucket.

11. A dehumidifier as claimed in claim 10, wherein the float comprises a tubular body having a closed top and an open bottom and the adjustment rod is mounted near the closed top so that the open bottom is disposed in the collected moisture.

12. A dehumidifier for extracting moisture from the atmosphere, the dehumidifier comprising:

a cabinet;

a refrigeration system generally disposed within the cabinet for extracting moisture from the atmosphere and including an interlock switch for turning on and off the power to the refrigeration system;

a bucket removably mounted to the cabinet to collect the moisture extracted by the refrigeration system; and a float provided within the bucket and responding to the moisture level in the bucket, the float having an actuator for actuating the interlock switch in response to the moisture level in the bucket to turn the power off and on, and a positioning shaft rotatably supported by the bucket such that the float is rotatably supported about a generally horizontal axis and wherein the float is slidable along the horizontal axis for varying the moisture level at which the power is turned off.

13. The dehumidifier as claimed in claim 12, wherein the float is slidably movable between at least two positions to adjust the float and wherein when the float is in a first of the at least two positions, the actuator actuates the interlock switch to turn off the power at a first moisture level, and when the float is in a second of the at least two positions, the actuator actuates the interlock switch at a second moisture level to turn off the power at a second moisture level.

14. A dehumidifier as claimed in claim 12, wherein the actuator is a variable height cam having a portion in contact with the interlock switch, the cam rotating in response to the moisture level from a run position, where the portion of the cam is in contact with the interlock switch and power is supplied to the refrigeration system, to an off position, where the portion of the cam is not in contact with the interlock switch and power is not supplied to the refrigeration system.

15. A dehumidifier as claimed in claim 14, wherein the bucket has a pair of collars that receive the positioning shaft and wherein the positioning shaft can be slid and rotated relative to the collars to slidably and pivotally mount the float to the bucket.

16. A dehumidifier as claimed in claim 12, wherein the float comprises a tubular body having a closed top and an open bottom and the positioning shaft is mounted near the closed top so that the open bottom is disposed in the collected moisture.

* * * * *